United States Patent [19]

Hamburg

[11] Patent Number: 4,677,956

[45] Date of Patent: Jul. 7, 1987

[54] SOLENOID DUTY CYCLE MODULATION FOR DYNAMIC CONTROL OF REFUELING VAPOR PURGE TRANSIENT FLOW

[75] Inventor: Douglas R. Hamburg, Birmingham, Mich.

[73] Assignee: Ford Motor Company, Dearborn, Mich.

[21] Appl. No.: 756,611

[22] Filed: Jul. 19, 1985

[51] Int. Cl.[4] ..... F02M 25/08

[52] U.S. Cl. ..... 123/520; 123/489

[58] Field of Search ..... 123/520, 519, 518, 521, 123/440, 489, 589

[56] References Cited

U.S. PATENT DOCUMENTS

| | | | |
|---|---|---|---|
| 3,538,896 | 11/1970 | Tobias et al. | 123/519 |
| 3,831,353 | 8/1974 | Toth | 55/387 |
| 3,963,009 | 6/1976 | Mennesson | 123/440 |
| 4,013,054 | 3/1977 | Balsley et al. | 123/519 |
| 4,275,697 | 6/1981 | Stoltman | 123/520 |
| 4,308,842 | 1/1982 | Watanabe et al. | 123/520 |
| 4,326,489 | 4/1982 | Heitert | 123/520 |
| 4,377,142 | 3/1983 | Otsuka et al. | 123/440 |

FOREIGN PATENT DOCUMENTS

| | | | |
|---|---|---|---|
| 57-86555 | 5/1982 | Japan | 123/519 |
| 1217400 | 12/1970 | United Kingdom . | |

*Primary Examiner*—Andrew M. Dolinar

*Attorney, Agent, or Firm*—Allan J. Lippa; Peter Abolins

[57] ABSTRACT

Fuel vapors are purged from a vapor storage canister to the intake of an internal combustion engine by inducting air into the vapor canister, modulating the purge flow of an air and fuel vapor mixture from the canister, and establishing a predetermined magnitude of combustion exhaust emissions by gradually changing the magnitude of a transient flow between no purge flow and a full purge flow so that the amount of combustion exhaust emissions is maintained below the predetermined magnitude.

2 Claims, 7 Drawing Figures

OPEN LOOP, FAST PURGE

SOLENOID DUTY CYCLE MODULATION FOR DYNAMIC CONTROL OF REFUELING VAPOR PURGE TRANSIENT FLOW

BACKGROUND OF THE INVENTION

1. Field of the Invention

This invention relates in general to an automotive type internal combustion engine and more particularly to a control device for variably controlling a purge of fuel vapors from a storage canister into the engine.

2. Prior Art

Carbon canister storage systems are known for storing fuel vapors emitted from an automotive-type fuel tank to prevent emission into the atmosphere of evaporative fuel components. These systems usually include a canister containing activated carbon with an inlet from the fuel tank or other reservoir. When the fuel vaporizes, the vapors will flow either by gravity or under vapor pressure into the canister to be adsorbed by the carbon inside. Filling the fuel tank with fuel may displace fuel vapors in the fuel tank and drive them into the canister. Subsequently, in most instances, the purge line connected from the canister outlet to the carburetor or engine intake manifold purges the stored vapors into the engine during engine operation. The canister contains a purge fresh air inlet to cause a sweep of the air across the carbon particles to thereby desorb the carbon of the fuel vapors.

In most instances, a purge or nonpurge of vapors is an on/off type of operation. That is, either the purge flow is total or zero. For example, U.S. Pat. No. 3,831,353 to Toth teaches a fuel evaporative control system and associated canister for storing fuel vapors and subsequently purging them back into the engine air cleaner. However, there is no control valve mechanism to vary the quantity of purge flow. As soon as the throttle valve is open, the fuel vapors are purged continuously into the manifold.

U.S. Pat. No. 4,326,489 to Heitert teaches a fuel vapor purge control device that controls a vacuum servo mechanism connected to a valve member that is slidable across a metering slot to provide a variable flow area responsive to changes in engine intake manifold vacuum to accurately meter the re-entry of fuel vapors into the engine proportionate to engine airflow.

U.S. Pat. Nos. 4,013,054; 4,275,697; 4,308,842; 4,326,489 and 4,377,142 disclose fuel purging systems incorporating some form of air/fuel ratio control but include no provision for applying a sequence of time varying pulses to the solenoid purge control valve.

As described, typical onboard refueling vapor recovery systems use an activated carbon canister to store the gasoline vapors which are displaced when refueling of the vehicle is performed. These vapors are subsequently purged from the system into the engine by passing air into the canister. This causes a potential enrichment of the engine's air/fuel ratio and an increase in the engine's emissions, such as carbon monoxide and hydrocarbon.

Such undesirable effects of purging can be reduced with present day fuel systems which employ feedback from an EGO sensor in the engine's exhaust to regulate the air/fuel ratio. Unfortunately, air/fuel ratio feedback cannot instantaneously reduce the air/fuel perturbations which result from abrupt changes in purging because of the inherent propagation time through the engine and exhaust system. As a result, there will always be short periods of uncontrolled air/fuel perturbations whenever the refueling vapor purge flow changes abruptly, such as at the beginning or end of a purge command signal. An abrupt increase of a vapor filled purge, such as that from a vapor filled canister, can cause an undesirably rich air fuel ratio. On the other hand, an abrupt decrease with a substantially air filled purge, such as that from a vapor free canister, can also cause an undesirably rich air fuel ratio.

There still remains a need to control the purge flow into the engine so that desirable engine operating conditions, such as the air/fuel ratio, are maintained and control of emissions from the engine is maintained within desirable limits. These are some of the problems this invention overcomes.

SUMMARY OF THE INVENTION

In accordance with an embodiment of this invention, a control valve in the purge flow path is modulated during initiation and cessation of purge so that purge flow can be controlled to change gradually with respect to a zero flow level. As a result, engine operating parameters, such as the air/fuel ratio, can be controlled so as to control combustion exhaust emissions.

In particular, the duty cycle of pulse electrical signals applied to the control valve can be modulated so that purge flow gradually increases or decreases.

DETAILED DESCRIPTION OF THE INVENTON

Figure 1:
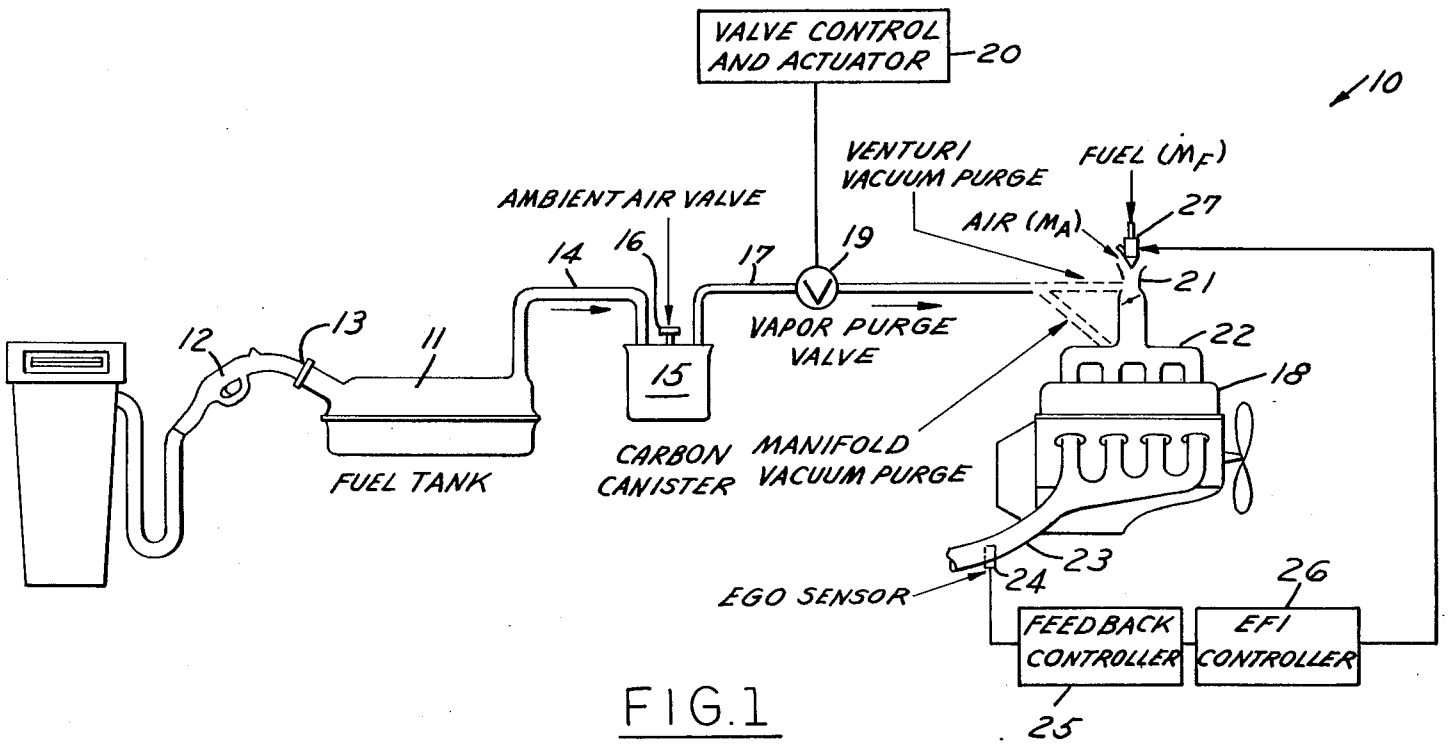
FIG. 1 is a block diagram of a refueling vapor recovery system in accordance with an embodiment of this invention.

Referring to FIG. 1, a refueling vapor recovery system 10 includes a fuel tank 11 which is coupled to a fuel filling nozzle 12 through a gas tight seal 13. Fuel vapors from fuel tank 11 pass through a conduit 14 to a carbon canister 15. Carbon canister 15 has an ambient air valve 16 for communicating ambient air into carbon canister 15. A conduit 17 extends from carbon canister 15 to the intake of an engine 18. A vapor purge valve 19 is positioned in conduit 17 to control the flow of vapor purge to engine 18. A valve control actuator system 20 is coupled to vapor purge valve 19 to control the opening and closing of valve 19. Conduit 17 can be connected to either the throttle intake 21 of engine 18 or to the intake manifold 22 of engine 18. An exhaust manifold 23 of engine 18 supports exhaust gas oxygen sensor 24. A signal from exhaust gas oxygen sensor 24 is applied to a feedback controller 25 which in turn applies a signal to an electronic fuel injection controller 26 which controls a fuel injector 27 to introduce fuel to engine 18.

Various control algorithms for valve control and actuator 20 coupled to the vapor purge valve are known. For example, referring to FIG. 2, a prior art open loop system with a fast purge, in response to a purge pulse, causes a shift in the air fuel ratio depending upon the condition of the canister. That is, when the canister is fully charged of fuel vapor, the start of a fast purge produces a rapidly decreasing air fuel ratio because of the introduction of additional fuel vapor. At the end of the purge, the air fuel ratio rises back to its prepurged value. The corresponding curves for decreasing amounts of fuel vapor in the canister are shown. When the air fuel ratio in the canister itself, that is, the ratio of air drawn in through ambient air valve 16 to the fuel vapor in canister 15, is substantially the same as the starting air fuel ratio of the engine system, the air fuel ratio stays constant throughout the purge. If the canister is substantially empty of fuel vapor, purging the canister causes the introduction of air into the intake of the engine and increases the air fuel ratio from that present before the start of the purge.

Figure 2:
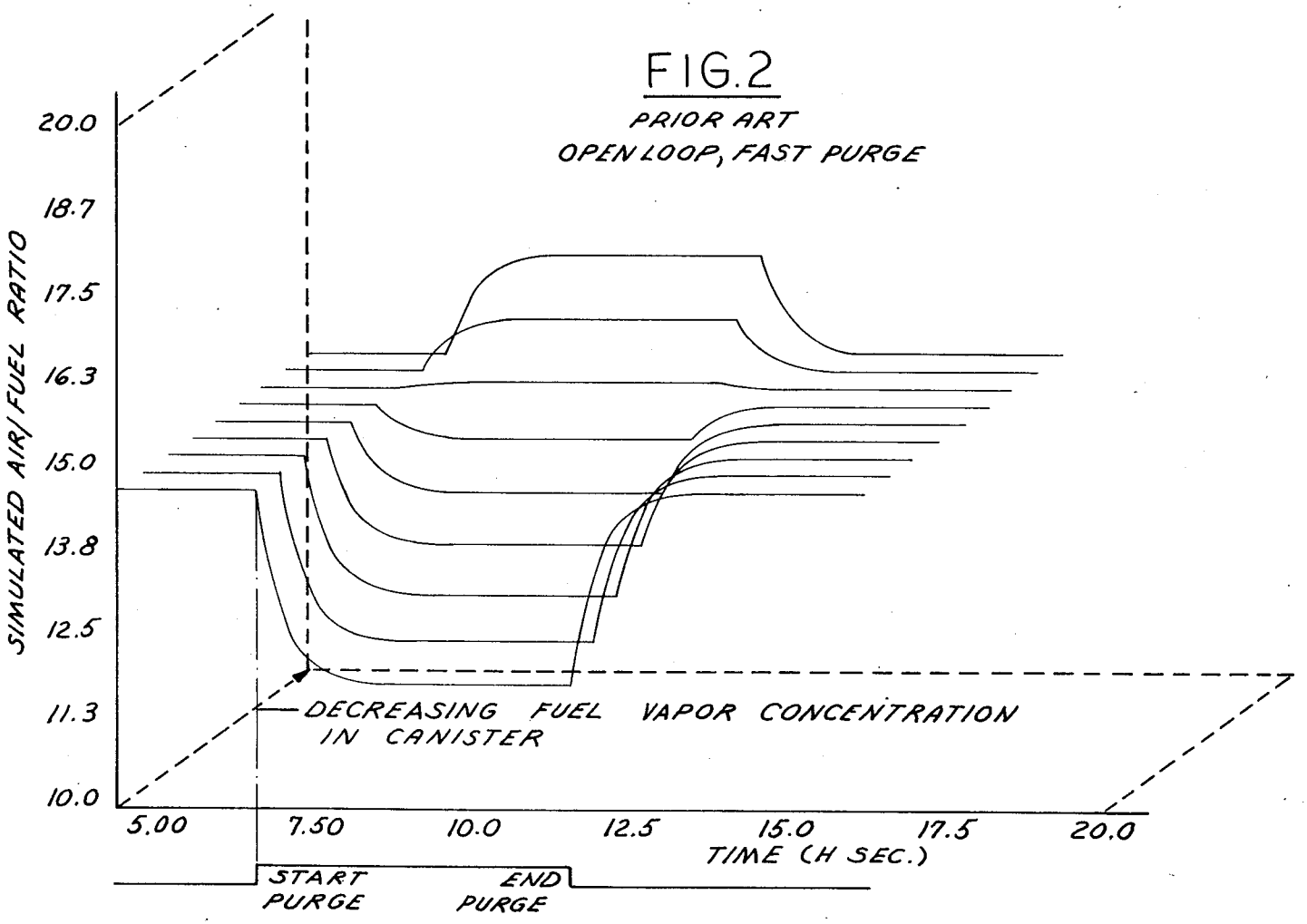
FIG. 2 PRIOR ART
FIG. 2 is a graphical representation of air fuel ratio versus time for the purging of a vapor canister having different states of fuel vapor charge in the canister ranging from a fully charged canister to an empty canister, using an open loop air fuel ratio control system in accordance with the prior art.
Figure 3:
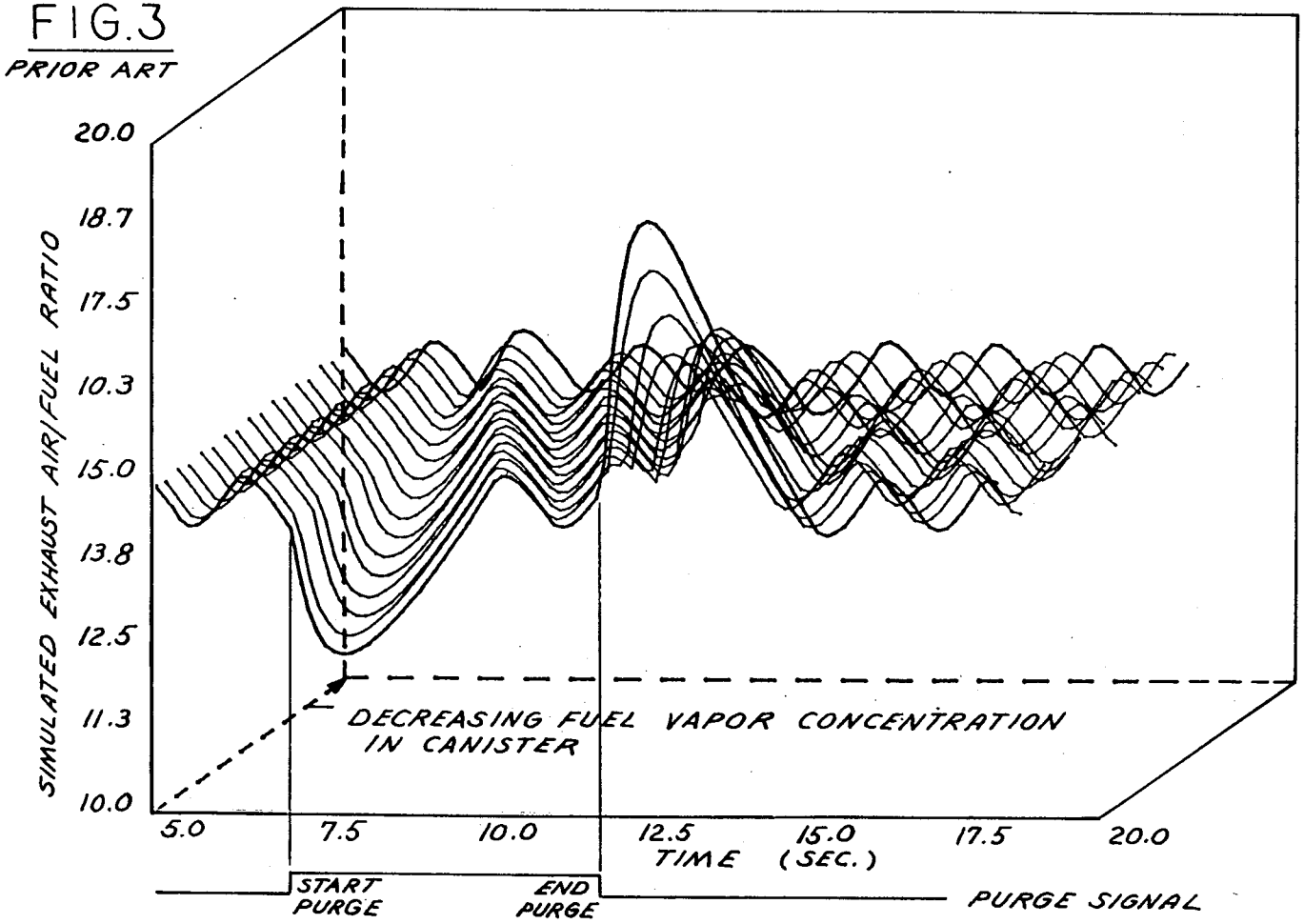
FIG. 3 PRIOR ART
FIG. 3 is a graphical representation of exhaust air fuel ratio versus time varying the purge of a fuel vapor canister using a closed loop, fast purge control system in accordance with the prior art.

Referring to FIG. 3, a prior art system for controlling purge using a closed loop system with feedback correction has transient response in the air fuel ratio but the deviation from the average air fuel ratio preceding purge is less than that in the open loop system shown in FIG. 2. When using this closed loop system with a canister full of fuel vapor, there is a large air fuel ratio transient at the start and at the end of the purge. At other times, the system is in a typical limit cycle variation of air fuel ratio.

Figure 4:
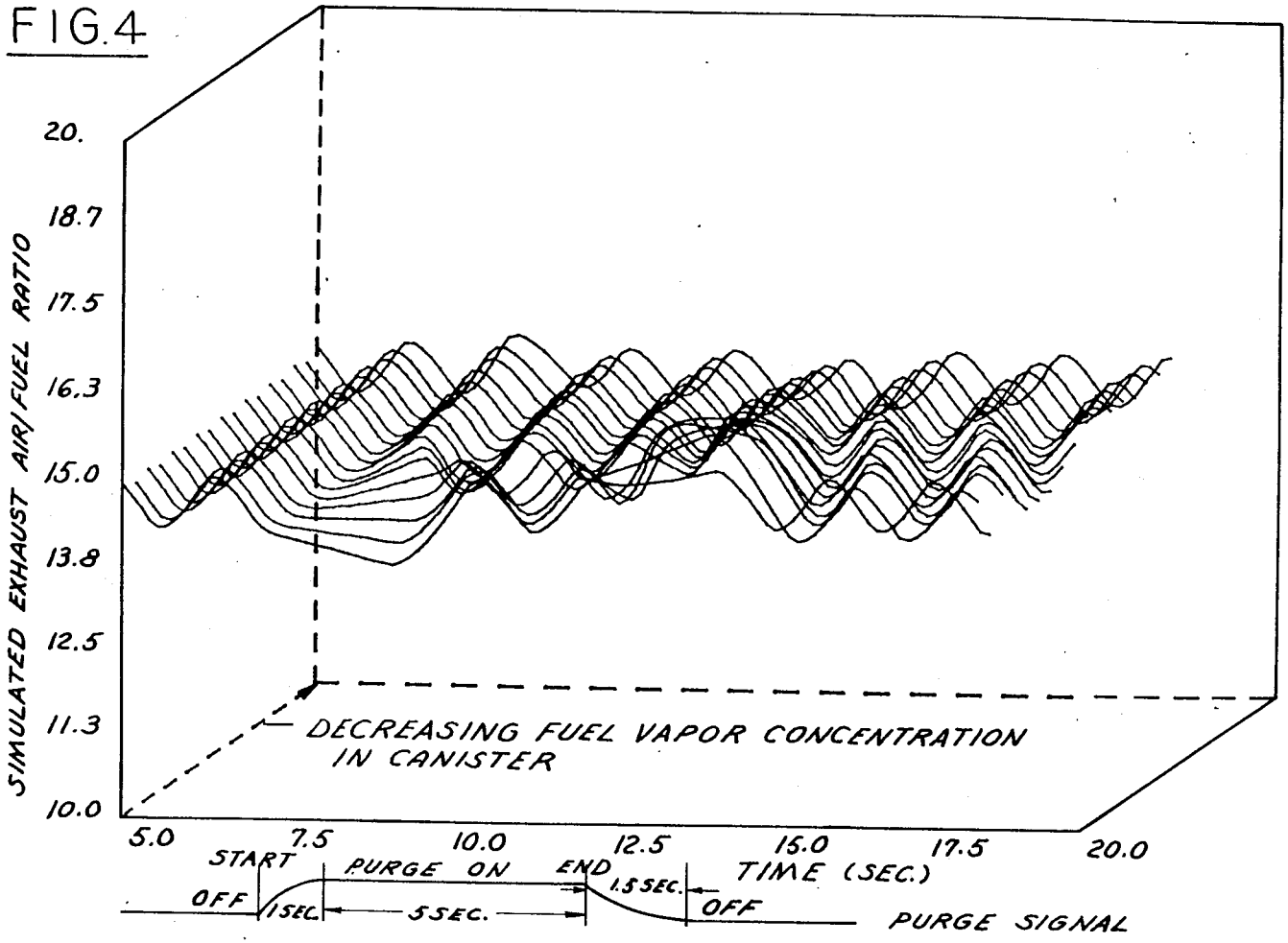
FIG. 4 is a graphical representation of exhaust air fuel ratio versus time and canister fuel vapor charge for the purge of a fuel vapor canister using a closed loop control system in accordance with an embodiment of this invention.

Referring to FIG. 4, the air fuel ratio versus time for various states of fuel vapor charge in the canister is shown using a closed loop air fuel control system in accordance with an embodiment of this invention wherein the transients between no purge and full purge are gradual. The purge signal is shown along the time axis and includes a transient portion gradually going from OFF to ON and then from ON to OFF.

Figure 5:
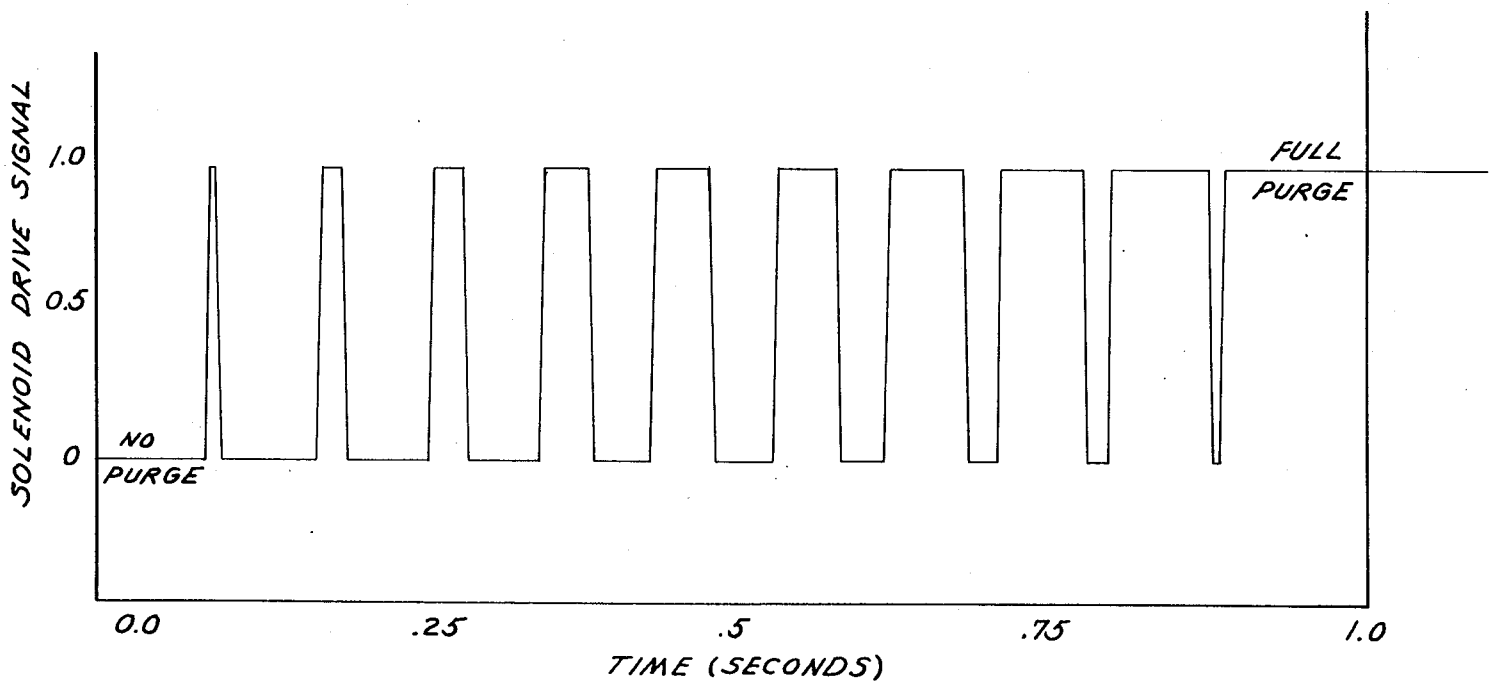
FIG. 5 is a graphical representation of solenoid valve position versus time during the transient fuel vapor purge flow from a no purge flow to a full purge flow.

The transition between no purge and full purge of the purge signal is shown in FIG. 5 using a graphical representation of the condition of vapor purge valve 19 versus time. Starting with a no purge condition, the solenoid switches to full purge by the application of a narrow pulse width. The solenoid returns to a no purge condition and then a full purge is applied for a slightly longer time than the first pulse applying full purge. As time progresses, the pulse width increases and the time between pulses decreases. Thus the purge flow is gradually increased, or feathered, from no flow to full flow in about one second. The signal causing flow to change from full purge to no purge when the purge is being concluded, is substantially a reverse of the signal shown in FIG. 5.

The signal for controlling vapor purge valve 19 in accordance with the graphical representation of FIG. 5 is generated by valve control and actuator 20. The duty cycle of the actuating signal applied to vapor purge valve 19 can be changed so as to gradually change the magnitude of the average flow through vapor purge valve 19. The duty cycle of the actuating signal can be changed in any number of ways, including increasing the pulse width, decreasing the time between successive pulses, decreasing the pulse width, and increasing the time between successive pulses. The magnitude of the maximum purge flow can also be varied to be proportional to the engine inlet airflow rate. Thus, even at a steady state, nontransient purge flow rate, vapor purge valve 19 may be modulated to achieve a purge flow rate different from that when vapor purge valve 19 is fully open. The duty cycle of the signal applied to vapor purge valve 19 can also be varied as a function of engine speed (RPM) and engine torque. Also, the duty cycle of the signal can be defined by a look-up table wherein, for example, the duty cycle is defined as a function of engine operating parameters. Modulation of vapor purge valve 19 can also be done as a function of air fuel ratio so that the difference between a desired air fuel ratio and a sensed actual air fuel ratio is less than a predetermined air fuel ratio error.

Figure 6:
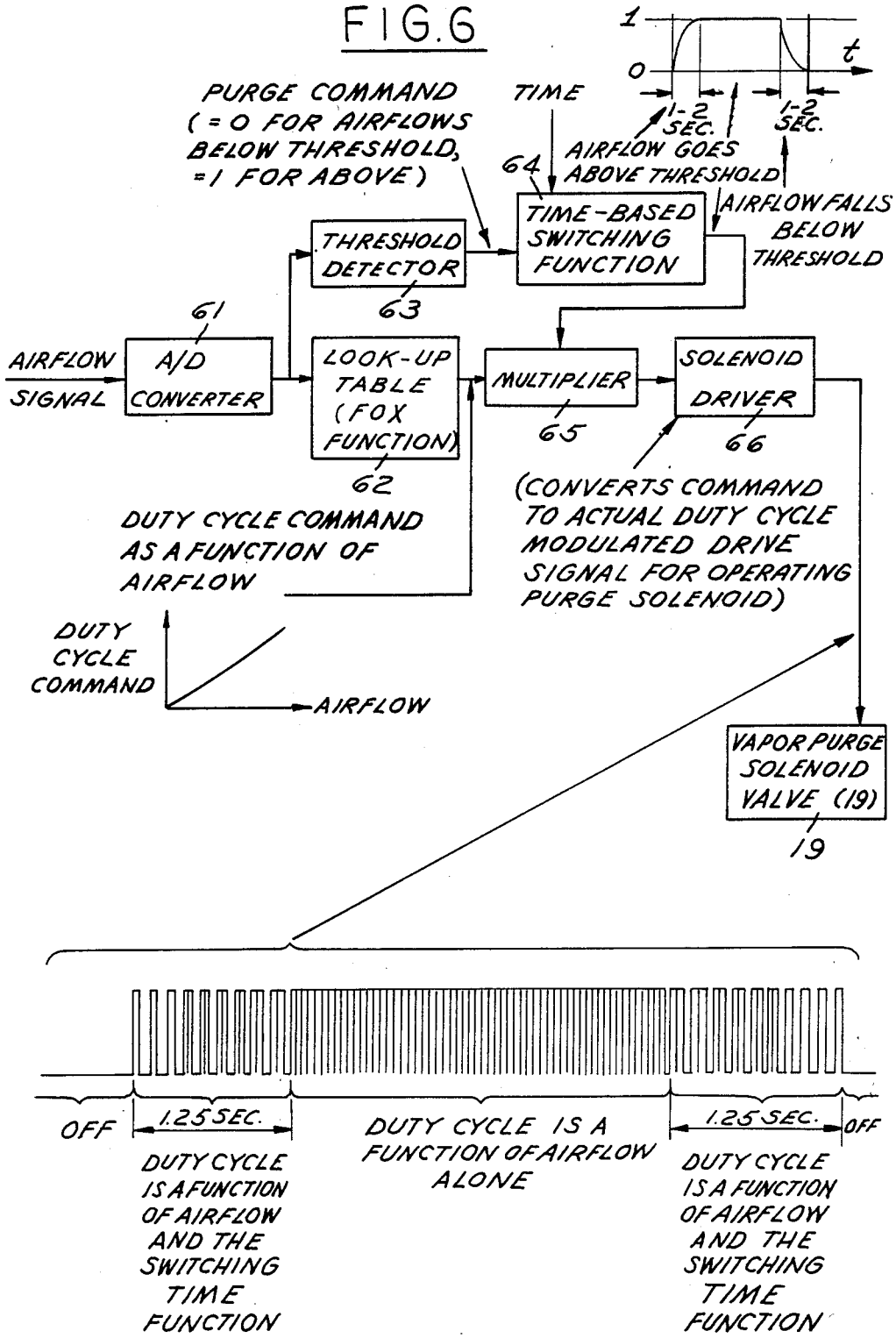
FIG. 6 is a block diagram of an embodiment of the valve control and actuator of FIG. 1 including waveforms at various portions of the block diagram.

Referring to FIG. 6, an embodiment of valve control and actuator 20 of FIG. 1 includes an airflow signal applied to an analog to digital (A/D) converter 61. The output from A/D converter 61 is applied to a look-up table 62 and to the series combination of a threshold detector 63 and a time based switching function 64. Time-based switching function 64 also has a time input and an output applied to a multiplier 65. The output of look-up table 62 is also applied to multiplier 65. The output of multiplier 65 is applied to a solenoid driver 66 which, in turn, applies a signal to vapor purge valve 19.

Also shown in FIG. 6 are waveforms at various locations in valve control and actuator 20. The output of threshold detector 63 is a purge command which is zero for airflow below a threshold and one for airflow above the threshold. The output of time-based switching function 64 provides a gradual transition between zero and one signal levels. The output of look-up table 62 is a command signal indicative of the desired solenoid duty cycle as a function of airflow. Solenoid driver 66 converts the duty cycle command signal to an actual duty cycle modulated drive signal for operating purge solenoid valve 19. When the airflow first goes above the threshold, the purge starts and the duty cycle is a function of both the airflow and the switching time functions. After the transition, the duty cycle is a function of the airflow alone. When the airflow falls below the threshold, the purge stops and the duty cycle is a function of both the airflow and the switching time function.

Figure 7:
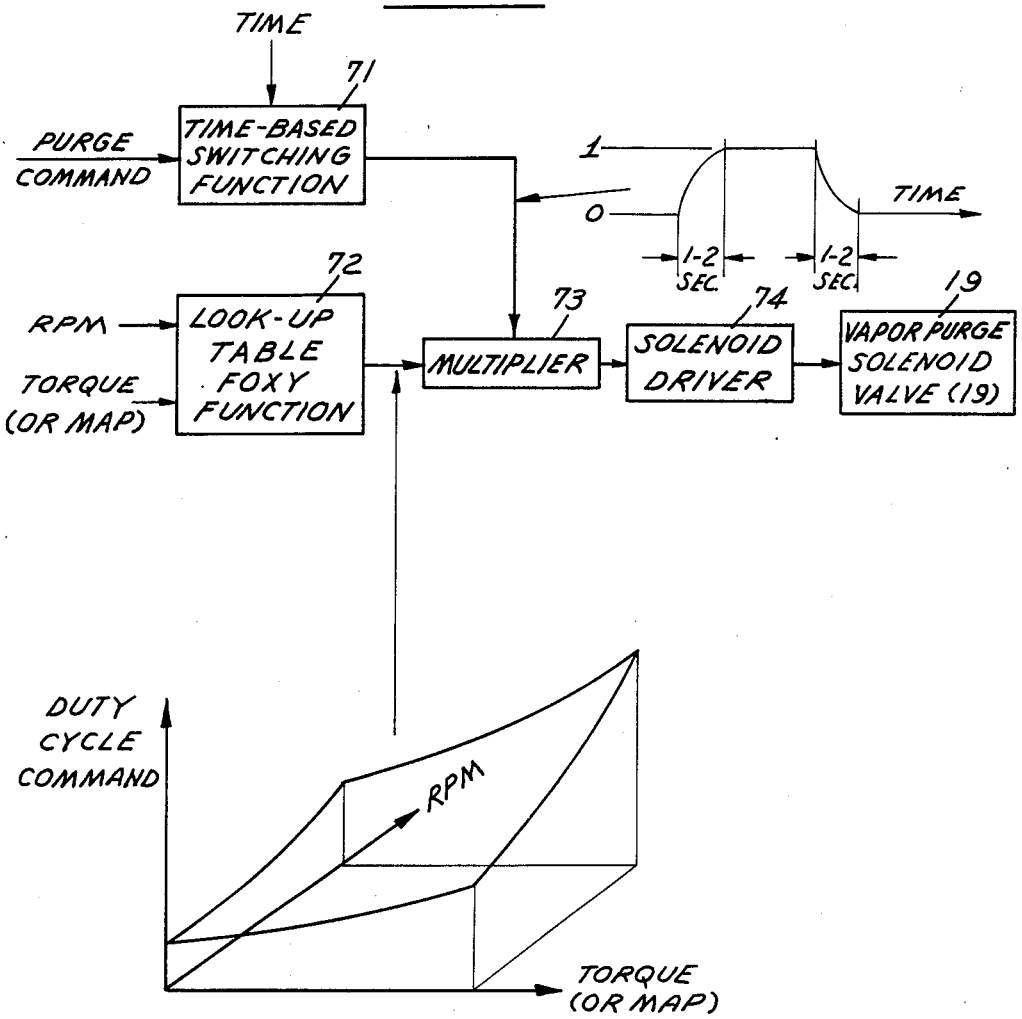
FIG. 7 is a block diagram of another embodiment of the valve control and actuator of FIG. 1 including waveforms at various portions of the block diagram.

Referring to FIG. 7, another embodiment of valve control and actuator 20 includes a time-based switching function 71 having time and a purge command as inputs. A look-up table 72 has inputs of engine speed (RPM) and a signal indicating engine torque (such as manifold absolute pressure) and an output command signal indicating duty cycle as a function of engine RPM and torque. The output of time-based switching function 71 and look-up table 72 are applied to a multiplier 73, whose output is applied to a solenoid driver 74. The output of solenoid driver 74 is applied to vapor purge solenoid valve 19 and has the same waveform transisiton as that shown in FIG. 6 as the output of solenoid driver 66.

Various modifications and variations will no doubt occur to those skilled in the arts to which this invention pertains. For example, the particular actuation of the solenoid valve may be varied from that disclosed herein. These and all other variations which basically rely on the teachings through which this disclosure has advanced the art are properly considered within the scope of this invention.

I claim:

1. A method of controlling purging of fuel vapors from a vapor canister storing fuel vapors from the fuel tank of an internal combustion engine to the intake of an internal combustion engine, including the steps of:

inducting a mixture of fuel and inlet air into the internal combustion engine;

providing a purge command signal during the time desired to purge the canister of vapors;

inducting purge air through the canister to induct a mixture of purge air and fuel vapor from the canister into the internal combustion engine in response to said purge command signal;

sensing an output parameter in the exhaust of said internal combustion engine indicative of the air/fuel ratio of the internal combustion engine;

regulating said mixture of fuel and inlet air in response to said output sensing to provide an air/fuel ratio of inlet air and purge air to fuel vapor and fuel within a predetermined range; and modulating the purge flow mixture of purge air and fuel vapor in response to initiation of said purge command signal, said modulating enabling gradual increase of purge flow from no purge flow during a predetermined transient time at the beginning of said purge command signal so that said regulating step is able to prevent the air/fuel ratio from exceeding said predetermined range during said predetermined transient time, and said predetermined transient time being approximately equal to the propogation time of a mixture of air and fuel through the same engine.

2. A method of controlling purging of fuel vapors from a vapor canister storing fuel vapors from the fuel tank of an internal combustion engine to the intake of an internal combustion engine, including the steps of:

inducting a mixture of fuel and inlet air into the internal combustion engine;

providing a purge command signal during the time desired to purge the canister of vapors;

inducting purge air through the canister to induct a mixture of purge air and fuel vapor from the canister into the internal combustion engine in response to said purge command signal;

sensing an output parameter in the exhaust of said internal combustion engine indicative of the air/fuel ratio of the internal combustion engine;

regulating said mixture of fuel and inlet air in response to said output sensing to provide an air/fuel ratio of inlet air and purge air to fuel vapor and fuel within a predetermined range;

modulating the purge flow mixture of purge air and fuel vapor in response to initiation of said purge command signal, said modulating enabling a gradual increase of purge flow from no purge flow during a predetermined transient time at the beginning of said purge command signal so that said regulating step is able to prevent the air/fuel ratio from exceeding said predetermined range during said predetermined transient time;

said step of modulating comprising placing a solenoid control valve in the flow path from the vapor canister to the intake of the internal combustion engine; selectively actuating the solenoid control valve with pulses fully opening the solenoid control valve; and changing the duty cycle of the actuating signal applied to the solenoid control valve to gradually change the magnitude of the average flow through said solenoid control valve; and said predetermined transient time being approximately equal to the propogation time of a mixture of air and fuel through said engine.

* * * * *